US012371888B2

(12) United States Patent
Dunigan

(10) Patent No.: US 12,371,888 B2
(45) Date of Patent: Jul. 29, 2025

(54) BIDET ATTACHMENT FOR A TOILET WITH INTEGRATED DEODORIZER SPRAY SYSTEM

(71) Applicant: OSPREY BIDET & POSTURE PERCH LLC, Middletown, NJ (US)

(72) Inventor: James Dunigan, Belford, NJ (US)

(73) Assignee: Destinked Bathroom LLC, Middletown, NJ (US)

( * ) Notice: Subject to any disclaimer, the term of this patent is extended or adjusted under 35 U.S.C. 154(b) by 247 days.

(21) Appl. No.: 18/325,093

(22) Filed: May 29, 2023

(65) Prior Publication Data

US 2024/0401319 A1 Dec. 5, 2024

(51) Int. Cl.
*E03D 9/08* (2006.01)
*E03D 9/00* (2006.01)

(52) U.S. Cl.
CPC ..... *E03D 9/08* (2013.01); *E03D 9/005* (2013.01)

(58) Field of Classification Search
CPC ..... E03D 9/08; E03D 9/005
USPC ..... 4/420.4
See application file for complete search history.

(56) References Cited

U.S. PATENT DOCUMENTS

| | | | | |
|---|---|---|---|---|
| 3,178,070 | A | 4/1965 | Leland | |
| 4,670,916 | A | 6/1987 | Bloom | |
| 6,029,286 | A | 2/2000 | Funk | |
| 6,178,563 | B1 | 1/2001 | Helfet | |
| 6,654,971 | B1 | 12/2003 | Middleton | |
| 10,869,583 | B2 | 12/2020 | Schwab et al. | |
| 11,193,263 | B1 | 12/2021 | Bensing et al. | |
| 12,076,739 | B1 * | 9/2024 | Lin | B05B 15/40 |
| D1,061,833 | S * | 2/2025 | Lin | D23/295 |
| 2004/0128751 | A1 | 7/2004 | Haq | |
| 2007/0067897 | A1 | 3/2007 | Graham, II | |
| 2017/0260728 | A1 | 9/2017 | Hall et al. | |
| 2019/0186116 | A1 | 6/2019 | Schwab | |
| 2022/0162843 | A1 | 5/2022 | Gupta et al. | |
| 2022/0298771 | A1 * | 9/2022 | Gupta | E03D 9/08 |
| 2023/0046125 | A1 | 2/2023 | Maniaci | |
| 2024/0060282 | A1 * | 2/2024 | Smith | B05B 9/03 |
| 2024/0115980 | A1 * | 4/2024 | Jeong | C02F 1/68 |

FOREIGN PATENT DOCUMENTS

| | | | |
|---|---|---|---|
| CN | 216130289 | U | 3/2022 |
| DE | 102021108067 | A1 | 10/2022 |
| JP | 2003253727 | A | 9/2003 |

(Continued)

*Primary Examiner* — Huyen D Le
(74) *Attorney, Agent, or Firm* — LaMorte & Associates, P.C.

(57) ABSTRACT

A bidet assembly that can be added to a toilet or integrated into the design of a toilet. The bidet assembly has a housing that is positioned between the bowl and the seat of the toilet. The bidet assembly also has a reservoir for holding a volume of an additive fluid. A water nozzle extends from the housing for spraying water that is supplied from an external water source through a plumbing connection. In addition, a spray head is provided that extends from the housing toward the bowl of the toilet. During use, the water nozzle sprays water and performs the cleaning function of a bidet. The secondary spray head sprays the additive fluid after the cleaning to deodorize and/or disinfect the bowl of the toilet.

14 Claims, 3 Drawing Sheets

(56) References Cited

FOREIGN PATENT DOCUMENTS

| | | |
|---|---|---|
| JP | 3101671 U | 6/2004 |
| KR | 200311032 | 4/2003 |
| KR | 2009-0098184 | 9/2009 |

* cited by examiner

BIDET ATTACHMENT FOR A TOILET WITH INTEGRATED DEODORIZER SPRAY SYSTEM

BACKGROUND OF THE INVENTION

1. Field of the Invention

The present invention relates to the structure and operation of bidet assemblies that attach to toilets. The present invention also relates to systems that automatically spray a deodorizer and/or a disinfectant into the bowl of a toilet after each use.

2. Description of the Prior Art

Traditionally, bidets are dedicated wash stations that are stand-alone units in a bathroom. That is, the bidet is traditionally separate and distinct from the toilet bowl. As a result, dedicated bidets require floor space and plumbing connections in a bathroom in addition to that used for the toilet. This makes traditional bidets quite expensive and unpractical to have in most bathrooms.

Recognizing the problems associated with traditional bidets, bidet attachments have been developed that are designed to attach to an existing toilet. Such prior art systems typically attach to the toilet between the toilet bowl and the toilet seat using the toilet seat mounting bolts. In such systems, the operational controls are positioned on the side of the toilet seat so as to be readily accessible by a person sitting on the toilet seat. Such prior art bidet systems are exemplified by U.S. Pat. No. 11,193,263 to Bensing.

Bidet attachments for toilets operate using the water supply of the toilet. The water is channeled to a spray head that is positioned within the toilet bowl. As such, the spray head of the bidet is only capable of spraying water. However, given the working purpose of a bidet, it may be beneficial to spray more than just water into a toilet bowl. For example, many people would recognize the advantages of spraying a deodorizer and/or a disinfectant into a toilet bowl.

In the prior art, there are many spray systems that are designed to spray deodorizers and/or disinfectants into a toilet bowl. Such prior art systems are exemplified by U.S. Pat. No. 6,029,286, to Funk and U.S. Patent Application Publication No. 2007/0067897 to Graham. However, such systems contain tubes, supply reservoirs, spray cannisters and the like that occupy space around the toilet bowl. As a result, it is often impractical and sometimes impossible to use both an auxiliary spray deodorizing system and an auxiliary bidet system on the same toilet.

A need therefore exists for an improved auxiliary bidet system for a toilet that contains an integrated deodorizer/disinfecting system, wherein the bidet system can first function as a bidet and then function as a deodorizer. This need is met by the present invention as described and claimed below.

SUMMARY OF THE INVENTION

The present invention is a bidet assembly that can be added to a toilet or integrated into the design of a toilet. The bidet assembly has a housing that is positioned between the bowl and the seat of the toilet. The bidet assembly also has a reservoir for holding a volume of an additive fluid.

A water nozzle extends from the housing for spraying water that is supplied from an external water source through a plumbing connection. In addition to the water nozzle, a spray head is provided that extends from the housing toward the bowl of the toilet. During use, the water nozzle sprays water and performs the cleaning function of a bidet. The secondary spray head sprays the additive fluid after the cleaning to deodorize and/or disinfect the bowl of the toilet.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention bidet assembly can be embodied in many ways, only one exemplary embodiment is illustrated. The exemplary embodiment is being shown for the purposes of explanation and description and is selected in order to set forth one of the best modes contemplated for the invention. The illustrated embodiment, however, is merely exemplary and should not be considered a limitation when interpreting the scope of the appended claims.

Figure 1:
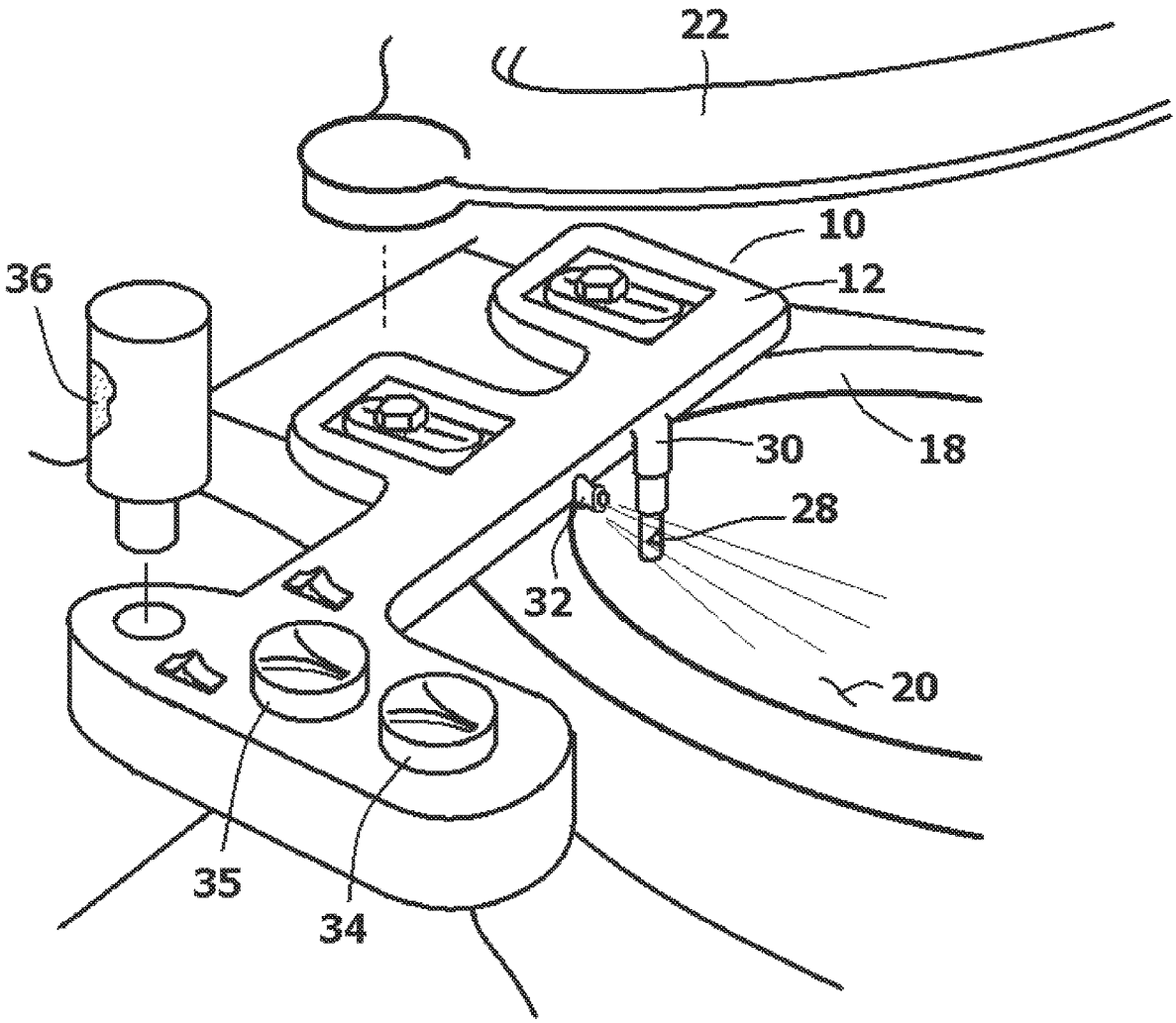
FIG. 1 shows an exemplary embodiment of a bidet assembly shown installed on a traditional toilet.
Figure 2:
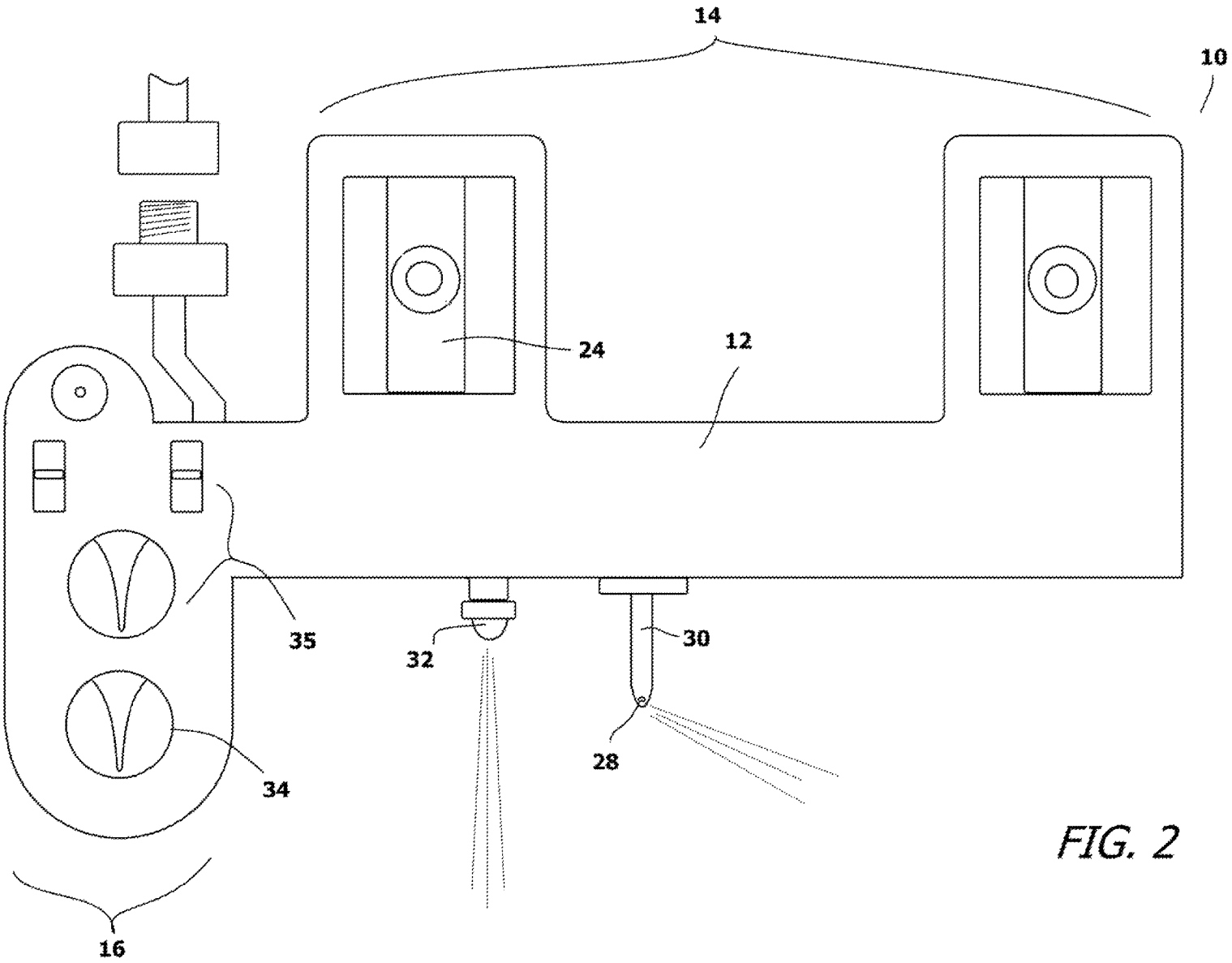
FIG. 2 shows a top view of the exemplary embodiment of the bidet assembly shown in FIG. 1.

Referring to FIG. 1 in conjunction with FIG. 2, an improved bidet assembly 10 is shown. The bidet assembly contains a housing 12. The housing 12 includes a mounting section 14 and a control section 16. The mounting section 14 mounts to the bowl 18 of a toilet 20 between the bowl 18 and the seat 22. The mounting section 14 has adjustable mounting slots 24 that are engaged by bolts 26 that connect the seat 22 to the bowl 18 of the toilet 20. In this manner, the improved bidet assembly 10 can be properly positioned on different makes and models of toilets 20.

The mounting section 14 of the improved bidet assembly 10 contains a bidet spray nozzle 28. The bidet spray nozzle 28 is positioned at the end of a descending arm 30 that extends into the bowl 18 from the housing 12. The bidet spray nozzle 28 sprays a jet of water in the traditional manner of a bidet. The water jet of the bidet spray nozzle 28 is directed in an upward direction in order to spray against a person sitting upon the seat 22 of the toilet 20.

A secondary spray head 32 is also supported by the mounting section 14 of the housing 12. The secondary spray head 32 is offset from the bidet spray nozzle 28 so that the spray from the bidet spray nozzle 28 does not interfere with the spray of the secondary spray head 32. Furthermore, the spray of the secondary spray head 32 is directed at a declining angle so that it sprays into the bowl 18 of the toilet 20 and not onto the person sitting on the seat 22 of the toilet 20.

The control section 16 of the housing 12 extends beyond the bowl 18 of the toilet 20. Accordingly, the control section 16 is cantilevered to the side of the seat 22 and remains accessible to any person who is sitting on the seat 22 of the toilet 20. The control section 16 contains various user controls. Bidet controls 34 activate and control fluid flow to the bidet spray nozzle 28 in the traditional manner. Additional spray controls 35 are provided to control fluid flow to and through the secondary spray head 32. The fluid flowing through the bidet spray nozzle 28 is water that is supplied through a plumbing connection. The fluid that flows through the secondary spray head 32 includes water mixed with an additive fluid 36. The preferred additive fluids 36 are deodorizers and/or disinfectants. However, other fluids, such as detergents, can also be used. The additive fluid 36 is stored within the improved bidet assembly 10.

Figure 3:
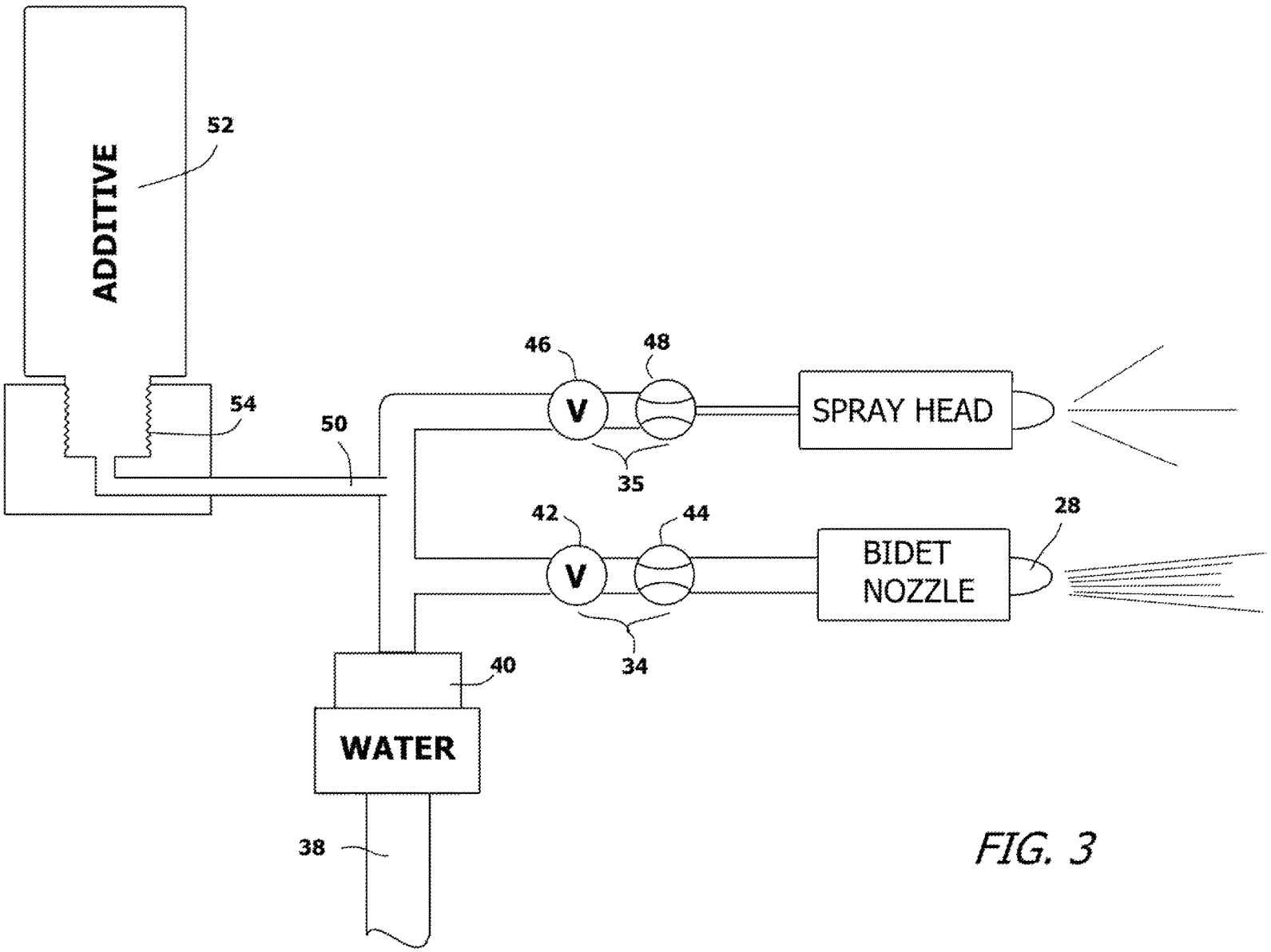
FIG. 3 is a schematic showing the various functional components contained within the bidet assembly.

Referring to FIG. 3 in conjunction with FIG. 2, it can be seen that the improved bidet assembly 10 receives water from a plumbing connection 40 that connects to the water supply hose 38 of the toilet 20. As a result, the water received is under pressure. The supplied water enters the plumbing connection 40 and is divided into two paths. Most of the supply water is directed toward the bidet controls 34 in the form of an on/off valve 42 and an adjustable flow restrictor 44. The bidet controls 34 control the flow of the water to and through the bidet spray nozzle 28.

A small amount of the water is directed to the secondary spray controls 35. The secondary spray controls 35 consist of a second on/off valve 46 and an optional adjustable flow restrictor 48. A tap lead 50 is provided at, or near, the secondary spray controls 35 that leads to a receptacle 54. The receptacle 54 is threaded and can receive and retain a removable reservoir 52. The removable reservoir 52 is preferably a small bottle or container that holds a supply of the additive fluid 36. The removable reservoir 52 can be selectively refilled or replaced as it empties.

Using the Venturi effect, the flow of water past the tap lead 50 draws some of the additive fluid 36 out of the removable reservoir 52. The drawn additive fluid 36 is preferably a deodorant and/or a disinfectant. The drawn additive fluid 36 mixes into the flowing water and travels to the secondary spray head 32. At the secondary spray head 32, the drawn additive fluid 36 is sprayed into the bowl 18 of the toilet 20.

During use, an individual sits on the seat 22 to use the toilet 20. The individual can then manipulate the bidet controls 34 to be sprayed with water through the bidet spray nozzle 28. At any point after using the bidet spray nozzle 28, the individual can utilize the secondary spray controls 35 to spray water and deodorant and/or disinfectant into the bowl 18 of the toilet 20.

The tubing and controls needed to draw and spray the additive fluid 36 are contained within the confines of the housing 12. Accordingly, no additional plumbing is required that would not otherwise be required for the operation of a traditional prior art bidet assembly.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A bidet assembly for a toilet having a water supply hose that receives water under pressure, wherein the toilet has a bowl and a seat, said bidet assembly comprising:

a housing that mounts to said toilet between said bowl and said seat;

a reservoir for holding a volume of an additive fluid, wherein said reservoir is supported by said housing;

a bidet spray nozzle that extends from said housing;

a spray head, separate from said bidet spray nozzle, that extends from said housing;

bidet controls that selectively control the flow of water received from said water supply hose to said bidet spray nozzle;

spray controls that selectively control the flow of said water received from said water supply hose to said spray head; and a tap lead disposed between said bidet controls and said spray controls that draws said additive fluid from said reservoir, wherein said additive fluid mixes into said water and travels to said spray head.

2. The assembly according to claim 1, wherein said spray head is oriented to spray some of said additive fluid into said bowl of said toilet when said housing is mounted to said toilet.

3. The assembly according to claim 1, wherein said bidet controls and said spray controls are accessible on said housing.

4. The assembly according to claim 1, wherein said reservoir is a refillable container that is removably attachable to said housing.

5. The assembly according to claim 4, further including a threaded receptacle formed in said housing for receiving said refillable container.

6. The assembly according to claim 1, further including a plumbing connection supported by said housing that enables said housing to connect to said water supply hose.

7. The assembly according to claim 6, wherein said plumbing connection directs water to both said bidet spray nozzle and said spray head.

8. The assembly according to claim 7, wherein said additive fluid is mixed into the water directed to said spray head.

9. An assembly, comprising:

a toilet having a bowl and a water supply connection for supplying water under pressure;

a bidet housing positioned above said bowl, wherein said bidet housing has a water nozzle that extends into said bowl;

a reservoir for holding a volume of an additive fluid, wherein said reservoir is supported by said bidet housing; and a spray head, separate from said water nozzle, that extends from said bidet housing;

bidet controls that selectively control the flow of said water received from said water supply hose to said water nozzle;

spray controls that selectively control the flow of water received through said water supply connection to said spray head; and a tap lead disposed between said bidet controls and said spray controls that draws said additive fluid from said reservoir, wherein said additive fluid mixes into said water and travels to said spray head.

10. The assembly according to claim 9, further including at least one manual control for activating said bidet controls and said spray controls.

11. The assembly according to claim 9, wherein said reservoir is a refillable container and is removably attachable to said bidet housing.

12. The assembly according to claim 11, further including a threaded receptacle formed in said bidet housing for receiving said refillable container.

13. The assembly according to claim 9, wherein said water supply connection directs water to both said water nozzle and said spray head.

14. The assembly according to claim 13, wherein said additive fluid is mixed into the water directed to said spray head.

* * * * *